US005592688A

United States Patent [19]

LaRonge et al.

[11] Patent Number: 5,592,688

[45] Date of Patent: Jan. 14, 1997

[54] REVERSIBLE CATCHING MITT

[75] Inventors: Ron LaRonge, San Jose; Thomas H. Grimm, Menlo Park; Diana L. Wooldridge, San Carlos; Scott H. Stillinger, Monte Sereno, all of Calif.

[73] Assignee: OddzOn Products, Inc., Campbell, Calif.

[21] Appl. No.: 303,496

[22] Filed: Sep. 9, 1994

[51] Int. Cl.[6] ..... A41D 13/08

[52] U.S. Cl. ..... 2/19; 2/161.1

[58] Field of Search ..... 2/16, 19, 2, 161.1, 2/159, 20; 273/25, 266

[56] References Cited

U.S. PATENT DOCUMENTS

| | | | |
|---|---|---|---|
| 1,423,546 | 7/1922 | Speer . | |
| 1,509,801 | 9/1924 | Walters | 2/19 |
| 1,984,183 | 12/1934 | Gillespie . | |
| 2,558,544 | 6/1951 | Delsalle | 2/19 |
| 2,750,594 | 6/1956 | Denkert | 2/19 |
| 3,916,448 | 11/1975 | Hamel . | |
| 4,029,316 | 6/1977 | Clarke . | |
| 4,197,592 | 4/1980 | Klein . | |
| 4,227,263 | 10/1980 | Zidele | 2/19 |
| 4,365,352 | 12/1982 | Zidele | 2/19 |
| 4,366,580 | 1/1983 | Zidele | 2/19 |
| 4,665,561 | 5/1987 | Aoki | 2/19 |
| 4,836,554 | 6/1989 | Robbins . | |
| 5,123,119 | 6/1992 | Dube . | |
| 5,136,725 | 8/1992 | Montero . | |
| 5,448,776 | 9/1995 | Caruso | 2/19 |

*Primary Examiner*—C. D. Crowder
*Assistant Examiner*—Larry D. Worrell, Jr.
*Attorney, Agent, or Firm*—Kolisch Hartwell Dickinson McCormack & Heuser

[57] ABSTRACT

A mitt having opposite, matching side expanses forming opposite sides of the mitt is disclosed. Each side expanse is made up of a foam layer sandwiched between opposed overlay layers. The mitt may be shaped for use either on the left hand or the right hand, with a web in the mitt having a reversible concavo-convex shape which is changed depending upon the hand with which the mitt is used.

3 Claims, 2 Drawing Sheets

REVERSIBLE CATCHING MITT

BACKGROUND OF THE INVENTION

This invention relates to a glove, and more particularly to what is referred to herein as a catching mitt, in that the mitt is worn on the hand of a player and assists the player in catching an object, such as a ball or other play object, thrown toward the user during the course of play.

SUMMARY OF THE INVENTION

One object of the invention is to provide an improved glove or mitt which features a layer of foam extending over opposite side expanses in the mitt serving, when worn on the hand, to provide protection for both the front and back of the hand.

Another object is to provide an improved construction for a mitt promoting economical manufacture of a mitt from an expanse of foam material.

Another object is to provide a very flexible mitt so that small and/or weak hands can easily and quickly close the mitt around a ball being caught.

Another object is to provide an improved form of mitt, wherein a given mitt is capable of being worn with equal facility either on the left hand or the right hand.

A related object is to provide a mitt which is capable of being worn on either the left or right hand, which includes opposite side expanses with foam extending about these side expanses, with a given side expanse forming either the front or the back of the mitt depending upon the hand with which the mitt is used.

The preferred form of mitt, and the one specifically herein disclosed, includes a pair of opposite side expanses, of matching outline, with each side expanse including a thumb cover portion, and extending outwardly at an angle from this thumb cover portion, a finger cover portion which is adapted to extend in covering relation over the fingers other than the thumb in the hand. With the side expanses against each other in the position that they have in the mitt, a web region is defined between the thumb cover and finger cover portions of the side expanses, and this web region is bridged with a web of concavo-convex shape. With the mitt used to cover one hand, the concavity of the web turns inside out and faces in one direction, and with the mitt used on the opposite hand, the concavity of the web faces in the opposite direction.

Each side expanse in the mitt includes a foam layer sandwiched between opposite fabric layers. The fabric layer which is on the inside of the mitt provides for moisture absorption and a more comfortable feel to the inside of the mitt. The fabric layer on the opposite side of the side expanse forms part of the exterior of the mitt and provides for abrasion resistance, etc. The fabric layer may also be various colors and patterns may be printed on or incorporated with it.

These and other objects and advantages are attained by the invention, which is described hereinbelow in conjunction with the accompanying drawings.

DETAILED DESCRIPTION OF THE INVENTION

Figure 1:
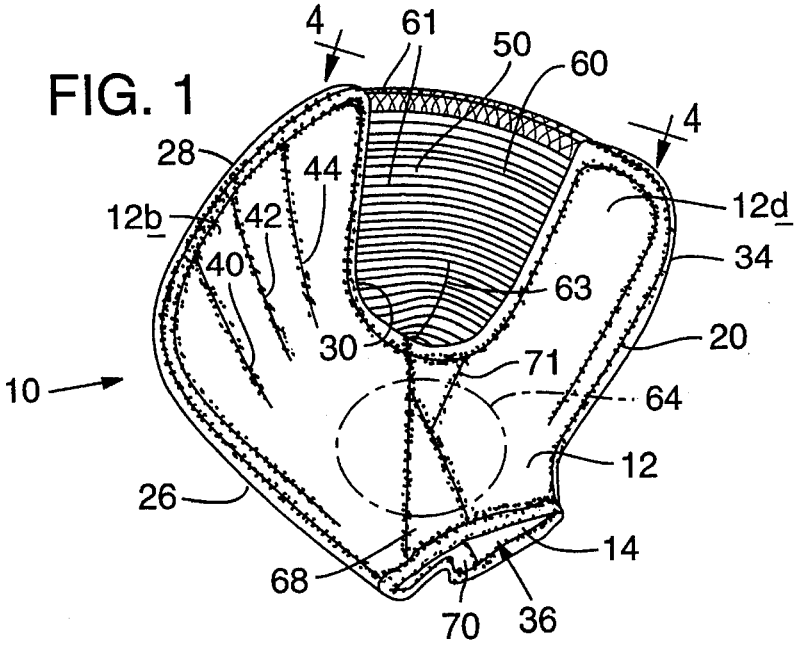
FIG. 1 illustrates a mitt as contemplated as such is shaped to be worn on the left hand of a user, the figure illustrating the back side of the mitt when used on the left hand.
Figure 2:
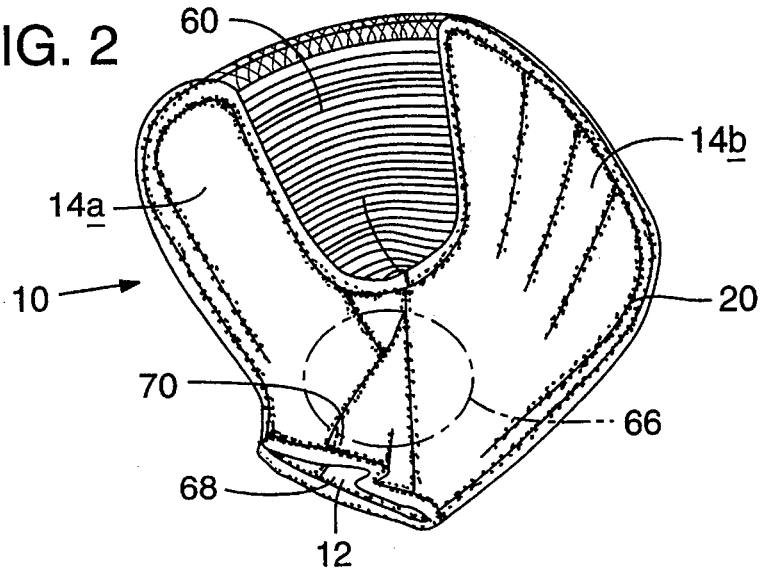
FIG. 2 illustrates the front side of the mitt illustrated in FIG. 1.

Referring to the drawings, a mitt 10 is illustrated which includes a pair of side expanses forming opposite sides of the mitt, as represented by side expanse 12 which faces the viewer in FIG. 1, and opposite side expanse 14 which is mostly obscured by side expanse 12 in FIG. 1 but which faces the viewer in FIG. 2. The mitt illustrated in FIGS. 1 and 2 is shaped to fit the left hand of the user, and side expanse 12 with this condition of the mitt forms the back side of the mitt while side expanse 14 with this condition of the mitt forms the front of the mitt.

The two side expanses have matching, symmetrically the same but opposite, outlines. Each has what is referred to herein as a thumb cover portion, shown at **12*a* for side expanse 12 and 14*a* for side expanse 14. Also part of the side expanse is what is referred to herein as a finger cover portion, shown for side expanse 12 at 12*b* and for side expanse 14 at 14*b***. In this connection it should be understood that when the term "finger" is used herein, it refers to one of the four terminating members of the hand other than the thumb and more specifically the forefinger, the little finger and the fingers therebetween.

Thumb cover portions **12*a*, 14*a* extend inwardly on the mitt from one lateral margin or extremity of the mitt, and finger cover portions 12*b*, 14*b*** extend laterally inwardly on the mitt from an opposite lateral margin or extremity.

Figure 6:
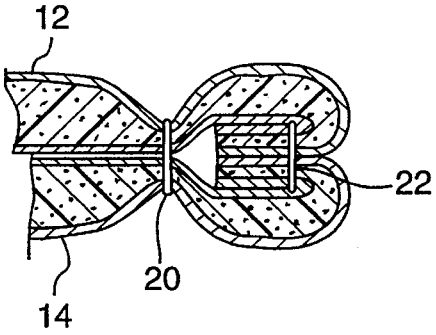
FIG. 6 is a sectional view, somewhat enlarged, taken along the line 6—6 in FIG. 3.

Side expanses 12, 14 in the mitt are joined to each other by stitching 20, 22 (see FIG. 6) extending along the perimeter of the mitt. The stitching joins the side expanses along the left edge of the mitt shown at 26 in FIG. 1, along the outer edge 28, along margin 30 extending between finger and thumb cover portions, and along right edge 34. This side expanses 12, 14 are left unjoined to each other in a hand entry region 36 at the base of the mitt, to permit the hand to be inserted into the mitt.

The side expanses may also be joined to each other by stitch lines 40, 42, 44. With this stitching, the finger cover portions of the respective side expanses are secured together and separate finger receiving pockets are formed to receive the four fingers of the hand. A single pocket is defined for the reception of the thumb.

In the mitt, the finger cover portions of the opposite side expanses seat the fingers with the fingers in approximately parallel array, as characterizes the "at rest" position in the normal hand. The thumb cover portions of the opposite side expanses form a pocket seating the thumb in a position extending out at a sharp angle from the seated position of the array of fingers, as characterizes the "at rest" position of the thumb in the normal hand.

Side expanse 12 which faces the viewer in FIG. 1 is shaped so that a space 50 is left between its thumb cover portion and its finger cover portion. In similar fashion, a space is left between the finger and thumb cover portions of expanse 14. In the complete mitt, these spaces register with each other and collectively define what is referred to as a web region. This region in the completed mitt is filled with a flexible web 60. The web is suitably joined along its perimeter to the finger and thumb cover portions of the glove or mitt. The flexible web shown in FIGS. 1, 2 fills the entire web region. Of course, flexible webs of other styles may be used, for example, woven or criss-crossed strips of fabric.

Web 60 has a concavo-convex or cup shape. With the mitt shaped as in FIGS. 1 and 2 for left hand wearing, the convex side of the web faces outwardly toward the back of the mitt, or toward the viewer in FIG. 1, whereas the concave side of the web faces in the opposite direction, or toward the viewer in FIG. 2. The web is secured in place in its mounted position with the thumb cover portions of the opposite side expanses drawn inwardly toward the finger cover portions of the side expanses, so that the entire glove has a concavity which faces the viewer in FIG. 2 and a concavity which faces the viewer in FIG. 1. The mitt may also include a stitched dart 71 to enhance the overall concavo-convex shape of the mitt.

Figure 4:
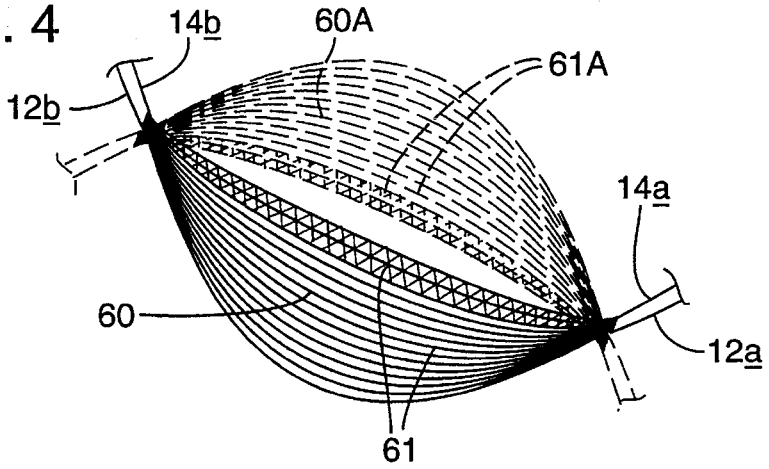
FIG. 4 is a view looking at a portion of the edge of the mitt, generally along the line 4—4 in FIG. 1, and illustrating a concavo-convex shape in a web which is part of the mitt.

FIG. 4 illustrates portions of the glove looking downwardly at the outer edges of the thumb and finger cover portions. The convex side of the web just referred to which faces toward the viewer in FIG. 1 faces downwardly and to the left as the portions of the glove are illustrated in FIG. 4.

Figure 3:
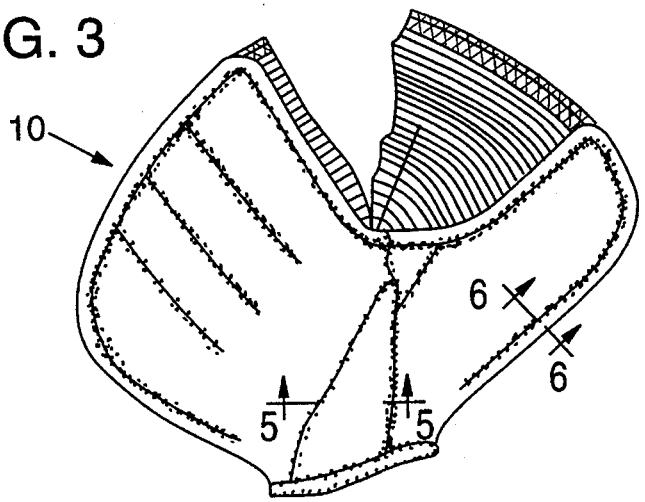
FIG. 3 illustrates the mitt with a web in the mitt broken away so that the mitt is illustrated in a flattened out condition.

To illustrate the drawing together of the thumb and finger cover portions, which has occurred with placement of the web, in FIG. 3 the web is shown destroyed by breaking it away. This enables the opposite side expanses of the glove to lay out in a flattened state.

Each side expanse includes a mid-hand covering region which is approximately that region encircled by the dot-dashed outlines in FIGS. 1 and 2 identified as 64 and 66. With the glove as positioned in FIGS. 1 and 2, the mid-hand cover region indicated at 64 for side expanse 12 extends over the back of the hand, whereas mid-hand cover region 66 for side expanse 14 covers the palm of the hand.

Each mid hand cover region includes a yield section, indicated for the two regions as 68 and 70, respectively, of greater flexibility than the remainder of the side expanse and preferably having stretchability and/or an elastic property. A yield section typically might be made up of an expanse of spandex or tricot material. This permits the mitt most effectively to accommodate use on either the left hand or the right hand of the user.

Further explaining, in FIGS. 1 and 2 the mitt is shown as used on the left hand, with side expanse 12 facing the viewer in FIG. 1 being the outer side expanse, and side expanse 14 facing the viewer in FIG. 2 being the inner side expanse. With this condition of the glove, the outer side expanse assumes a more or less convex shape to cover the back of the hand, and its section 68 suitably flattens out or stretches to accommodate this shaping. Side expanse 14 which forms the inner side of the glove shapes in concave fashion, with section 70 in this inner side expanse retracting or folding somewhat on itself to accommodate this shaping.

As is evident from FIGS. 1 and 2, the inside curvature of the mitt has a smaller radius than the outside curvature. Therefore, wrinkles could form on the inside curve or palm area. However, the elastic property of the yield sections prevents wrinkles from forming.

It is a relatively easy matter with the fingers to shape the glove for use on the right hand. To do so, web 60 is turned in on itself, so that its convex side faces away from the viewer in FIG. 1 and toward the viewer in FIG. 2. This produces shaping of the glove so that the web assumes the general shape indicated in dashed outline in FIG. 4. With this condition of the mitt, section 70 in side expanse 14 flattens out. Section 68 in side expanse 12 folds on itself somewhat to accommodate the concavity which forms on the other side of the glove.

Figure 5:
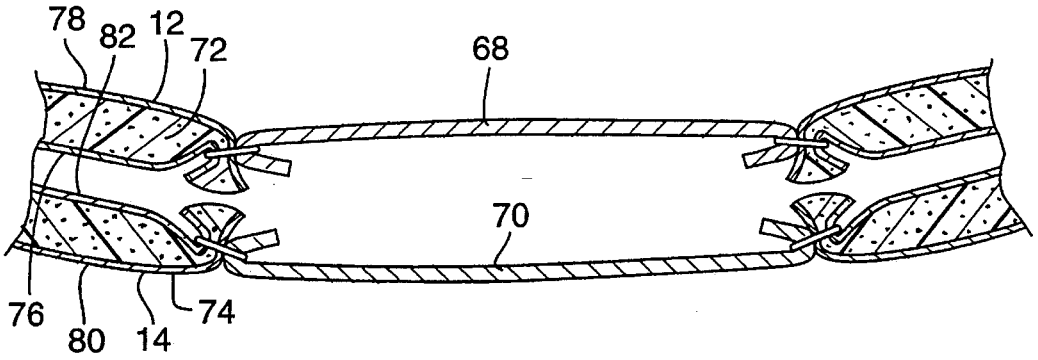
FIG. 5 is a sectional view, somewhat enlarged, taken generally along the line 5—5 in FIG. 3.

For padding and comfort reasons, each side expanse includes a foam layer extending throughout the finger cover portion of the side expanse as well as the thumb cover portion in the side expanse, and also through the mid-hand cover region of the side expanse, except for the areas of flexible section 68, 70 described. In FIG. 5, this foam layer is illustrated at 72 for side expanse 12 and at 74 for side expanse 14. In a typical embodiment, the foam may be around ¼-inch thick. It may also be a slow-return or non-resilient foam to deaden the impact of an object when it is caught by the mitt.

In each side expanse the foam layer in the side expanse is sandwiched between overlays such as fabric overlays. In FIG. 5, such overlays are shown for layer 72 in expanse 12 at 76 and 78, and for layer 74 in expanse 14 at 80 and 82. The foam may be laminated onto the fabric to facilitate manufacture of the glove and handling of the side expanses.

The foam layers and fabric overlays also permit the mitt to accommodate different sized hands. For larger hands the foam will compress, creating more room for the hand. For smaller hands, the foam will not compress as much, but will occupy space allowing the mitt to maintain its functionability. The foam acts as a stiffening support for the structure of the mitt and for the fabric overlays.

In the completed mitt, the overlays of the foam layers which become positioned on the inside of the mitt may be a fabric or other desired material and may be selected to provide absorbency for moisture generated during use of the mitt, and to provide for a more comfortable feel. The foam layer will also provide absorbency for moisture. The overlays which become positioned on the outside of the side expanses are selected of a material such as a fabric which provides abrasion resistance and contributes to longevity in the life of the mitt. The fabric may be somewhat stretchable to enhance comfort and to fit over different sized hands, but attaching the foam to the fabric may limit the stretchability. The fabric may be such that it stretches primarily in one direction, such as tricot. If that fabric is used, it may be oriented so the stretch direction is across the length of the finger pockets to accommodate different sized fingers and to provide additional stretch to augment that of the yield section and to prevent wrinkling of the mitt's palm area.

Stitching 20 described produces a bead which extends about the perimeter of the mitt contributing a degree of stiffness and enhancing the ability of the mitt to maintain its proper shape. If desired, a stiff insert member may be included in the bead to increase the stiffness along the perimeter of the mitt.

Web 60 may also be made from two expanses of foam sandwiched between fabric overlays. The web is stiffened by stitching the expanses together as shown at 61 in FIG. 1. The amount of stitching and/or the distance of separation between the stitching determines the flexibility of the web. Stitching 61 may, of course, be in patterns different than parallel lines. The web may also include a dart stitching 63 to help form the concavo-convex shape of the web.

It should be obvious that the mitt is capable of relatively economic manufacture. In the mitt described, an elastomer foam layer is found in the side expanse which forms both the front and the back of the mitt regardless of the hand with which the mitt is used. The foam layer which forms the front of the mitt provides for cushioning in the catching of the object. The foam layer which forms the back of the mitt provides protection to the hand from scraping etc. The mitt contemplated according to the preferred embodiment is relatively easily shaped for wearing either on the right or the left hand. The same configuration of mitt therefore can be used in equipping a plurality of players without regard to whether these players are left or right handed.

While preferred modifications of the invention have been described, it should be obvious that other modifications and variations are possible without departing from the invention.

It is claimed and desired to secure by Letters Patent:

1. A catching mitt usable either for the left or the right hand where the hand has fingers in an approximately parallel array and an outwardly projecting thumb, the mitt comprising:

a first side expanse facing in one direction and an opposite side expanse facing in the opposite direction, the two side expanses having substantially matching outlines and each side expanse including a thumb cover portion extending inwardly at one lateral extremity of the mitt and a finger cover portion extending inwardly from an opposite lateral extremity of the mitt, the finger cover portions of the two expanses seating the fingers of the hand with the fingers in an approximately parallel array and the thumb cover portions of the two side expanses seating the thumb with the thumb extending out at a relatively sharp angle from the array of fingers, each side expanse of the mitt including a layer of foamed elastomer material which extends over the thumb cover portion and the finger cover portion of the side expanse and which protects the front of the hand with the side expanse facing forwardly on the hand, each side expanse of the mitt further having a space located between the thumb cover portion and the finger Cover portion accommodating independent movement of these portions, the space in one side expanse lying opposite the space of the other side expanse and said spaces collectively outlining a web region in the mitt, and which further includes a web in the mitt bridging this web region which draws the thumb and finger cover portion together to shape a cup-shaved concave deformable pocket which faces in one direction outwardly with the mitt usable for the left hand and which is deformable so that the concavity of the pocket may face in the opposite direction with the mitt used for the right hand.

2. The mitt of claim 1, wherein the first and second side expanses each have a mid-hand cover region joining with the finger cover portion and with the thumb cover portion of the side expanse, and the mid-hand cover region includes a relatively flexible yield section of greater flexibility than the remainder of the side expanse.

3. The mitt of claim 2 wherein the yield section is elastic.

* * * * *